US005771851A

United States Patent [19]

McLean

[11] Patent Number: 5,771,851

[45] Date of Patent: Jun. 30, 1998

[54] VARIABLY TUNED HELMHOLTZ RESONATOR WITH LINEAR RESPONSE CONTROLLER

[75] Inventor: Ian R. McLean, Chatham, Canada

[73] Assignee: Siemens Electric Limited, Ontario, Canada

[21] Appl. No.: 902,454

[22] Filed: Jul. 29, 1997

[51] Int. Cl.[6] ..... F02M 35/10

[52] U.S. Cl. ..... 123/184.57

[58] Field of Search ..... 123/184.53, 184.57, 123/184.61, 184.56

[56] References Cited

U.S. PATENT DOCUMENTS

| | | | |
|---|---|---|---|
| 4,538,556 | 9/1985 | Takeda | 123/184.57 |
| 4,539,947 | 9/1985 | Sawada et al. . | |
| 4,546,733 | 10/1985 | Fukami et al. | 123/184.57 |
| 4,592,311 | 6/1986 | Makino | 123/184.32 |
| 5,162,621 | 11/1992 | Lee | 181/229 |
| 5,267,543 | 12/1993 | Novak et al. | 123/188.14 |
| 5,377,629 | 1/1995 | Brackett et al. | 123/184.56 |
| 5,492,089 | 2/1996 | Hiraoka et al. | 123/184.57 |
| 5,572,966 | 11/1996 | Doddy et al. | 123/184.57 |

FOREIGN PATENT DOCUMENTS

| | | | |
|---|---|---|---|
| 1-117919 | 5/1989 | Japan | 123/184.57 |

*Primary Examiner*—David A. Okonsky
*Attorney, Agent, or Firm*—Russel C. Wells

[57] ABSTRACT

A variably tuned Helmholtz resonator which has a connection establishing fluid communication between fixed volume chamber and a duct of an induction system for an internal combustion engine. The tubular connection has a special configuration which affects changes in open area and length of the tubular connection so as to create a linear relationship between the resonant frequency and the angular position of the tuning plate. The tuning plate is positioned correspondingly to engine speed to provide noise attenuation over a wide range of engine speeds.

10 Claims, 4 Drawing Sheets

VARIABLY TUNED HELMHOLTZ RESONATOR WITH LINEAR RESPONSE CONTROLLER

BACKGROUND OF THE INVENTION

Helmholtz resonators have been employed in internal combustion engine induction systems to reduce engine noise. Such resonators consist of a fixed volume chamber connected to an induction system duct by a tubular connection or neck. The frequency associated with the primary order of engine noise is directly proportional to engine speed, but a fixed geometry Helmholtz resonator is only effective at attenuating noise in a narrow frequency range, such that the resonator would be ineffective in attenuating primary order noise over much of the complete range of engine speeds encountered during normal operation of a vehicle powered by the engine.

It has heretofore been proposed that a Helmholtz resonator be variably tuned in accordance with engine speed in order to increase the range of engine speeds over which the resonator will be effective to suppress primary order engine noise. This approach is described in U.S. Pat. No. 4,539,947 which shows a movable element mounted within the tubular connection or neck between the duct and the Helmholtz chamber. The position of the movable element is varied in accordance with engine speed to vary the effective cross sectional area and/or length of the tubular connection. This has the effect of changing the resonant frequency of the Helmholtz resonator so as to be effective over a wider range of engine speeds.

However, the effect of change in cross sectional area and length of the tubular connection on the resonant frequency is markedly non linear, such that the design and performance of controls to execute proper movement of the movable element in correspondence with engine speed is rendered problematic.

It is the object of the present invention to provide a variably tuned Helmholtz resonator in which a linear response to the control variable is achieved.

SUMMARY OF THE INVENTION

The above-recited object of the present invention is achieved by providing a tuning plate pivoted to sweep across the cross section of a tubular connection between the resonator chamber and a duct with which the resonator is associated. The tubular connection has a particular curved roughly triangular cross sectional shape produced by mapping the bisector of a triangle onto the radius of a circle, such that incremental angular movements of the plate produce a proportionate change in the open area of the tubular connection.

The tubular connection extends down into the resonator chamber and is truncated such that end corrected effective length remains effectively constant as the tuning plate is swept across the width of the tubular connection.

The end result is a linear relationship between the angular position of the tuning plate and the resonant frequency of the Helmholtz resonator.

Thus, by positioning the timing plate in correspondence to an engine speed signal, noise suppression across most of the engine operating speed range can be achieved.

DETAILED DESCRIPTION

In the following detailed description, certain specific terminology will be employed for the sake of clarity and a particular embodiment described in accordance with the requirements of 35 USC 112, but it is to be understood that the same is not intended to be limiting and should not be so construed inasmuch as the invention is capable of taking many forms and variations within the scope of the appended claims.

Figure 1:
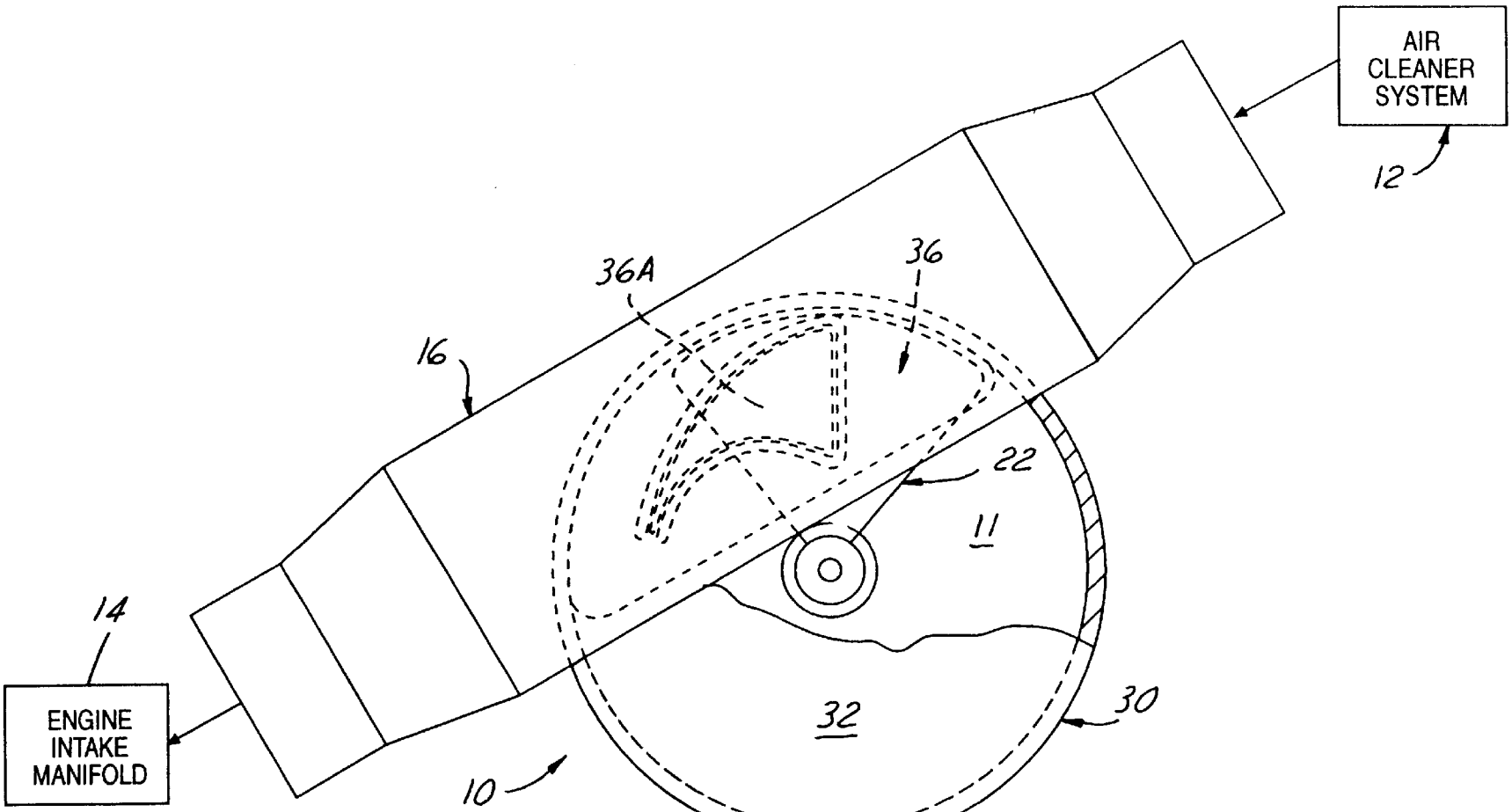
FIG. 1 is a plane view of the tunable Helmholtz resonator according to the invention, with a diagrammatic representation of the associated engine components.
Figure 2:
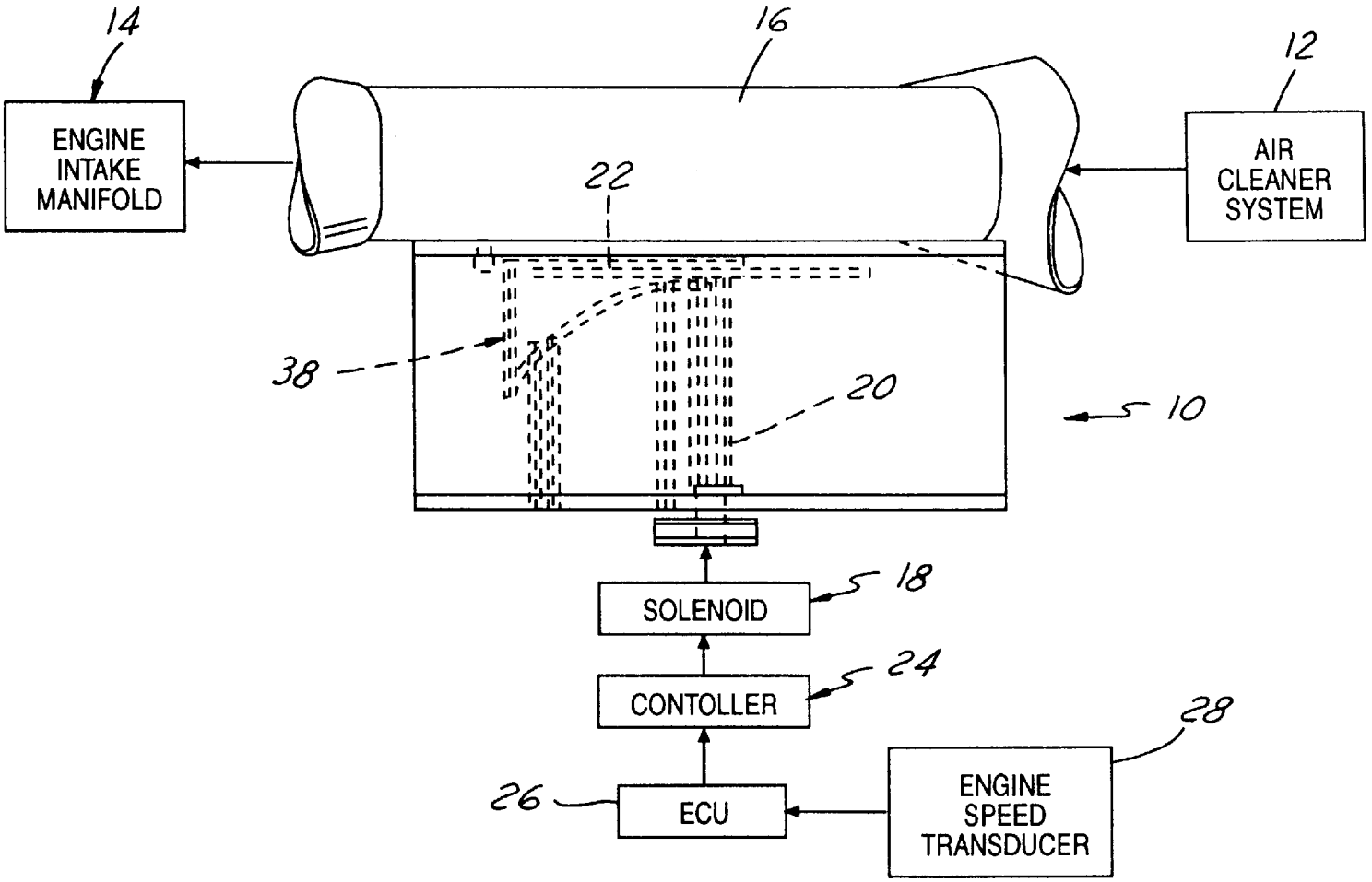
FIG. 2 is a side elevational view of a tunable Helmholtz resonator and connected duct transition according to the present invention, together with a diagrammatic representation of the associated control components.
Figure 3:
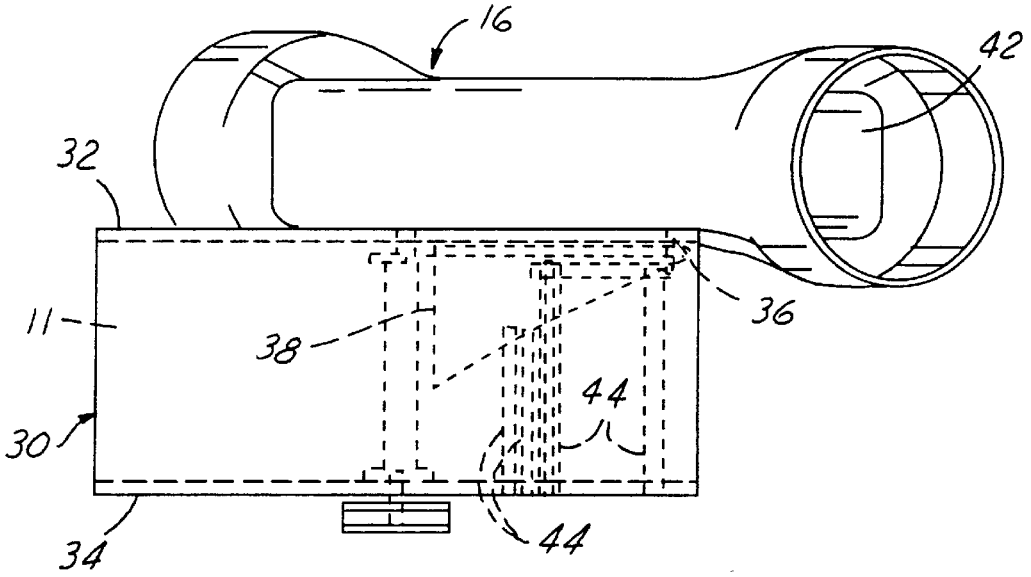
FIG. 3 is a side elevational view of the resonator and duct transition shown in FIG. 1 from the reverse side.
Figure 3A:
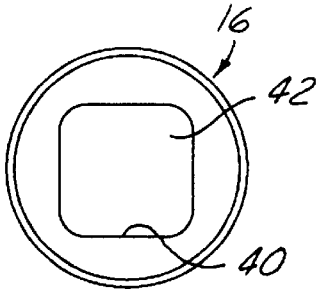
FIG. 3A is an end view of the transition pipe.

Referring to FIG. 1, the present invention comprises a linearly tuneable Helmholtz resonator 10, installed in the induction system of an engine, intermediate the engine air cleaner 12 and intake manifold 14. A square to round transition duct piece 16 enables a connection at either end to rounds duct connecting to the engine components.

A solenoid actuator 18 drivingly engages a rotary tuning shaft 20 so as to swing a tuning plate 22 about the axis of the tuning shaft 20.

Driver signals are applied to a controller 24 to cause the solenoid actuator 18 to rotate the tuner shaft 20, the driver signals generated from the vehicle ECU 26, which in turn receives signals from an engine speed transducer 28.

The angular position of the tuning shaft 20 and plate 22 is thereby set in correspondence to engine speed.

The Helmholtz resonator 10 comprises a fixed volume chamber 11, defined by a hollow cylindrical housing 30 closed off at its top and bottom with cover plates 32, 34. A roughly triangularly shaped opening 36 in the top cover plate 32 has a correspondingly shaped tubular connection or neck 38 aligned therewith and affixed to the inner surface of top cover plate 32.

Transition duct piece 16 has an opening matching the opening 36A in the top plate 32 and aligned therewith, the flat bottom wall 40 fixedly attached to the top plate 32. Thus, the chamber 11 is in fluid communication with the interior 42 of the duct transition piece 16 via an internal passage 36B of the tubular connection 38 recessed into the chamber 11.

The tubular connection 38 is supported on the bottom cover plate 34 with a series of posts 44 projecting upwardly and engaging respective sections of the bottom edges of the tubular connection 38.

Figure 4:
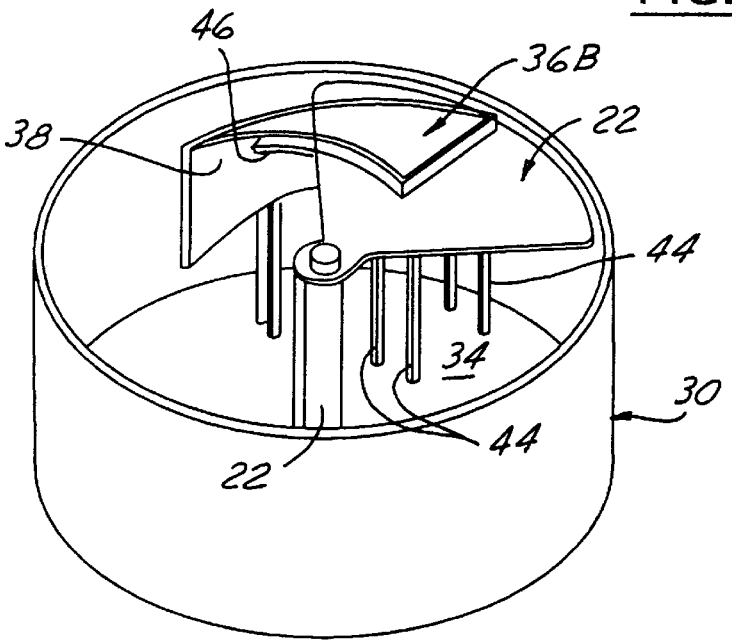
FIG. 4 is a perspective view of the resonator and duct transition shown in FIG. 1 with a top cover plate removed.

As best seen in FIG. 4, the tuning plate 22 is received in a slot 46 extending partially through the connector 38 adjacent its upper end so as to be able to partially block to a varying degree the internal passage 36B defined within the tubular connection 38.

The bottom of the tubular connection 38 is truncated in order to affect the effective length of the neck defined by the connection 38 as the tuning plate 22 is swung through the slot 46.

The geometry of the internal passage 36B of tubular connection 38 is configured such that a linear relationship is established between the cross sectional area of the internal passage 36B and angular position of the timing plate 22 in the range of partially blocking positions.

The resonant frequency of a Helmholtz resonator $f_R$ is given by:

$$f_R=(c/2\pi)\ [\sqrt{(s/L'V)}]$$

where: c=speed of sound

S=cross sectional area of neck

L'=end corrected length of neck

V=volume of cavity

In order to obtain a resonator with a linear response to a tuning variable, we need a resonator with a variable geometry such that:

$$f_R=\alpha\theta$$

where $\alpha$ is a constant and $\theta$ is the tuning variable.

For the order tracking Helmholtz resonator 10, the cross sectional area of the tubular connection 38, S will be the geometrical component which will be made variable. The volume of the cavity 11 will be held fixed.

Figure 5:
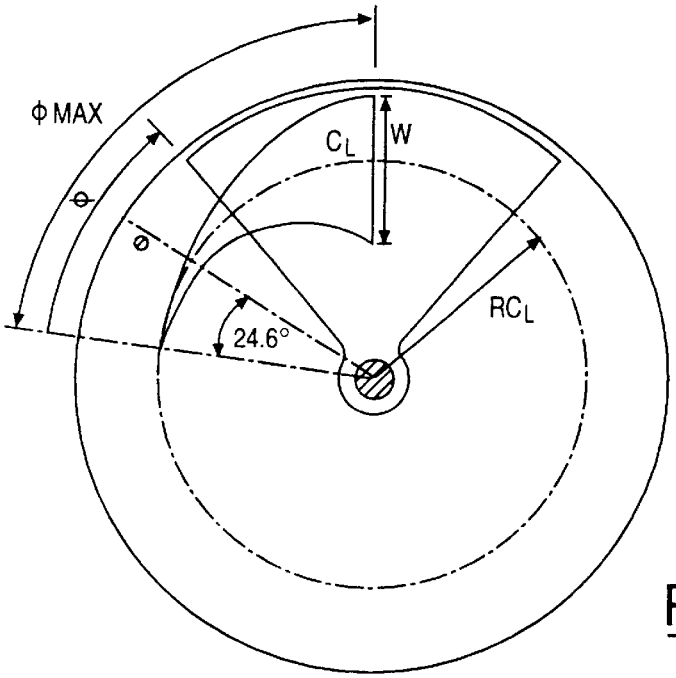
FIG. 5 is a diagrammatic plan view of the resonator showing the relationship between the tuning plate and tubular connection opening.

The design for the cross sectional area is shown in FIG. 5 for the tuning plate angle $\theta$.

The open area of the connector internal passage 36B is given by:

$$S=(RC_L/2)\ w \sin\theta$$

where: $RC_L$=70 mm and $\theta$=tuning angle in radians w=maximum width of neck opening at tuning plate angle $\theta$.

The variable w can be expressed as:

$$w=W\ (\theta/\phi_{max})$$

where: W=50 mm and $\phi_{max}$=1.431 radians (i.e., 82°).

So, $$S=(RC_L/2)\ (W)\ (\theta/\phi_{max})\ \sin\theta$$

Expanding sin $\theta$ in a Taylor's series, i.e.:

$$\sin\theta=\theta-(\theta^3/3!)+(\theta^5/5!)-\ldots$$

and substituting into the express for 5 yields:

$$S=W(C_L\backslash 2)\ (\theta/\phi_{max})\ [\theta-(\theta^3/3!)+(\theta^5/5!)-\ldots]$$

Retaining only the leading term for sin $\theta$, the open cross sectional area can be approximated as:

$$S=W(C_L\backslash 2)\ (\theta/\phi_{max})\ (\theta)$$

Or:

$$S\approx(WRC_L\backslash 2)\ (\theta^2/\phi_{max})$$

Also, the end-corrected tubular connector length L' can be expressed as:

$$L'=L+1.5a$$

where: L=midpoint length of the neck a=hydraulic radius of the neck, i.e., $$a=[\sqrt{(s/\pi)}]$$

So, $$L'=L+1.5a[\sqrt{(s/\pi)}]$$

L' is to be fixed, i.e., independent of the tuning angle $\theta$. So, the tubular connection 38 length L must compensate for the end correction, i.e., $$L=L_o-1.5[\sqrt{(s/\pi)}]$$

where: $L_o$=constant (length)=15 mm

So, the end-corrected length is:

$$L'=L_o \text{ which is fixed.}$$

Note that the length L is a linear function of the tuning plate angle:

$$L=L_o-1.5\ (WRC_L/2\pi\phi_{max})\theta$$

Figure 7:
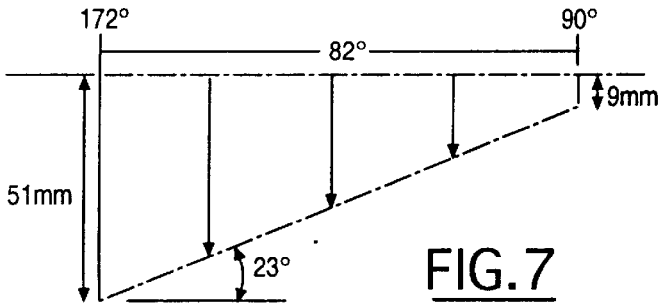
FIG. 7 is a dimensioned side elevational diagram of the truncation of the tubular connection.

That is, as the angle $\theta$ of tuning plate 22 is increased, the midpoint length L decreases linearly (see FIG. 7 showing the effect of the truncated lower end of the tubular connector 38).

So, the tuning frequency of the order-tracking resonator is given by:

$$f_R=(C/2\pi)\ [\sqrt{(s/L'V)}]=\alpha\theta$$

where: $\alpha=(C/2\pi)\ (1/L_oV)^{1/2}\ (WRC_L/2\phi_{max})^{1/2}$

In practice, the tuning plate angle is established by solenoid 18 which will be powered by a signal from the ECU 26 proportional to the engine speed. The relationship between the frequency of the primary order engine noise and engine speed is given by:

$$f_p=(N/2)\ (RPM/60)$$

where: RPM=engine speed

N=number of cylinders

When the resonator is tuned such that the resonant frequency of the resonator matches the frequency of the primary order engine noise, $$f_R=f_P$$

the primary order engine noise is reflected back up the induction system toward the engine. The primary order engine noise is thus not allowed to radiate out of the induction inlet continuously for all engine speeds corresponding to the range of resonant frequencies of the resonator. For a four cylinder engine, this engine speed range for the current design is 1800 rpm–6000 rpm.

Figure 6:
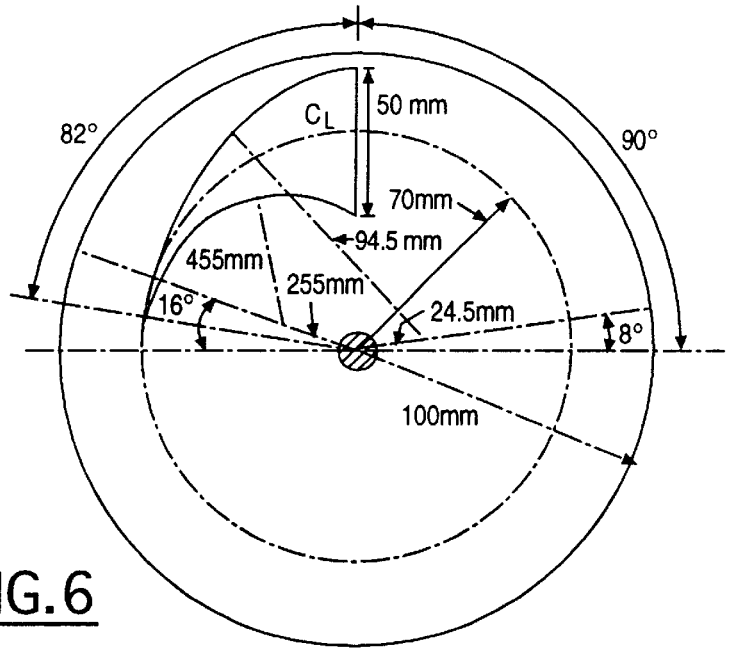
FIG. 6 is a dimensioned plan view of the resonator and connection opening.

FIG. 6 depicts an actual geometry of the opening 36 in the top plate 32 (as well as the tubular connection 38).

Accordingly, a much simpler, better performing control is enabled by the linear relationship between the tuning plate angle and the resonant frequency of the Helmholtz resonator.

I claim:

1. A tunable Helmholtz resonator for attenuating noise propagated through a duct, said resonator comprising:

a resonator chamber;

a tubular connection having an internal passage establishing fluid communication between said duct and said resonator chamber;

a tuning member mounted to be movable across said tubular connection to vary the cross sectional area thereof;

an actuator for driving said tuning member to cause said tuning plate to assume any of a series of predetermined positions, each partially blocking said tubular connection internal passage to a varying extent;

a control signal source transmitting signals to said actuator to cause said tuning member to be moved to a position in a range of partially blocking positions in correspondence thereto;

said internal passage having a shape configured to provide a linear relationship between the position of said tuning member through said range of partially blocking positions and said open cross sectional area of said internal passage.

2. The tuneable Helmholtz resonator according to claim 1 wherein said tubular connection has a truncated end so as to cause the effective length thereof to decrease linearly as said tuning member is moved to increasingly block said internal passage, whereby a linear relationship between the position of said tuning member and the resonant frequency of said Helmholtz resonator is established.

3. The tuneable Helmholtz resonator according to claim 2 wherein said control signal source generates signals corresponding to engine speed, whereby the resonant frequency of said Helmholtz resonator is varied linearly with engine speed.

4. The tuneable Helmholtz resonator according to claim 2 wherein said timing member comprises a timing plate pivotally mounted to be swingable across said tubular connection to vary the open area thereof, the angular position thereof having a linear relationship with the resonant frequency of said Helmholtz resonator.

5. The tuneable Helmholtz resonator according to claim 3 wherein said control signal source generates signals corresponding to engine speed, whereby the resonant frequency of said Helmholtz resonator is varied linearly with engine speed.

6. The tuneable Helmholtz resonator according to claim 4 wherein said cross sectional shape of said internal passage comprises an approximately triangular shape, with curved sides to produce a linear increase in the distance along a side of said tuning plate between the curved sides of said triangle with angular changes in position of said tuning plate in the direction of increasing spacing between said triangle sides.

7. The tuneable Helmholtz resonator according to claim 6 wherein a slot is formed through walls of said tubular connector defining said triangle sides and said tuning plate is movable therein.

8. A method of tuning a Helmholtz resonator in correspondence with a variable parameter, said Helmholtz resonator having a fixed volume chamber and a tubular connection having an internal passage in fluid communication with said chamber, said method comprising the steps of:

mounting a tuning element to be movable across said internal passage to progressively change the open cross-sectional area thereof; and, configuring said internal passage so that there is a linear relationship between the position of said tuning element and the open area of said internal passage.

9. The method according to claim 8 further including the step of configuring the lengthwise shape of said internal passage so that the length is shortened linearly in relationship to the movement of said tuning element in a direction decreasing said open cross-sectional area of said internal passage.

10. The method according to claim 9 wherein said parameter comprises engine speed in an internal combustion engine to change the resonant frequency of said Helmholtz resonator linearly with changes in engine speed.

* * * * *